US010934844B2

(12) United States Patent
Engel et al.

(10) Patent No.: US 10,934,844 B2
(45) Date of Patent: Mar. 2, 2021

(54) GAS TURBINE ENGINE WITH FAIL-SAFE SHAFT SCHEME

(71) Applicant: Rolls-Royce Corporation, Indianapolis, IN (US)

(72) Inventors: Chadd D. Engel, Danville, IN (US); Bradford J. Riehle, Plainfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 511 days.

(21) Appl. No.: 15/994,480

(22) Filed: May 31, 2018

(65) Prior Publication Data

US 2019/0368355 A1 Dec. 5, 2019

(51) Int. Cl.
*F01D 5/06* (2006.01)

(52) U.S. Cl.
CPC ..... *F01D 5/066* (2013.01); *F05D 2240/60* (2013.01); *F05D 2260/84* (2013.01)

(58) Field of Classification Search
CPC ..... F01D 5/066; F01D 5/026; F16C 3/023; F16C 2226/62; F16C 2360/23; F05D 2260/30; F05D 2260/31
See application file for complete search history.

(56) References Cited

U.S. PATENT DOCUMENTS 1,399,816 A * 12/1921 Spiess ..... F01D 5/066 416/248
5,537,814 A * 7/1996 Nastuk ..... F01D 5/066 60/796
5,796,202 A 8/1998 Herron et al.
6,827,548 B2 12/2004 Coxhead et al.
7,452,188 B2 11/2008 Bouchard
8,794,923 B2 8/2014 Tirone, III et al.
8,875,378 B2 11/2014 Coffin
9,291,070 B2 3/2016 Fielding et al.
9,556,894 B2 1/2017 Coffin
2006/0251506 A1 11/2006 Soupizon
2014/0096508 A1 4/2014 McCune et al.

FOREIGN PATENT DOCUMENTS

EP 2118445 A1 11/2009
EP 3269943 A1 1/2018
WO 2008110429 A1 9/2008

OTHER PUBLICATIONS

Extended European Search Report, European Application No. 19173005.0-1006, dated Oct. 15, 2019, 6 pages.

* cited by examiner

*Primary Examiner* — Richard A Edgar
(74) *Attorney, Agent, or Firm* — Barnes & Thornburg LLP

(57) ABSTRACT

A gas turbine engine comprises an engine core, a tie bolt, and a fail-safe system. The engine core includes a compressor, a turbine, and a shaft that couples the compressor with the turbine for rotation with the turbine about an axis. The tie bolt locates axially the compressor relative to the turbine. The fail-safe system is configured to transmit torque from the turbine to the compressor through the tie bolt in response to a shaft disconnect event.

20 Claims, 10 Drawing Sheets

GAS TURBINE ENGINE WITH FAIL-SAFE SHAFT SCHEME

FIELD OF THE DISCLOSURE

The present disclosure relates generally to gas turbine engines, and more specifically to gas turbine engines that include tie bolts.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors and turbines typically include alternating stages of static vane assemblies and rotating wheel assemblies. The rotating wheel assemblies include disks carrying blades around their outer edges. When the rotating wheel assemblies turn, tips of the blades move along blade tracks included in static shrouds that are arranged around the rotating wheel assemblies. Such static shrouds may be coupled with an engine case that surrounds the compressor, the combustor, and the turbine. In some engines, a tie bolt extends along an axis of the engine and applies a compressive force to the compressor and the turbine to locate them relative to each other.

SUMMARY

The present disclosure may comprise one or more of the following features and combinations thereof.

A gas turbine engine includes an engine core, a tie bolt, and a fail-safe system. The engine core may include a compressor stage, a turbine stage, and a shaft. The compressor stage and the turbine stage are adapted to rotate about an axis. The shaft rotatably couples the compressor stage to the turbine stage to transmit torque from the turbine stage through the shaft to the compressor stage to drive the compressor stage during operation of the gas turbine engine. The tie bolt extends axially along the axis and locates axially the compressor stage relative to the turbine stage. The fail-safe system is configured to provide backup torque-transfer means for transmitting the torque from the turbine stage to the compressor stage through the tie bolt in response to a shaft disconnect event in which the shaft fails to transmit the torque from the turbine stage to the compressor stage during operation of the gas turbine engine so that the turbine stage is blocked from rotating about the axis faster than the compressor stage during the shaft disconnect event.

In some embodiments, the fail-safe system includes a fore-torque interface and an aft-torque interface. The fore-torque interface is configured to transmit the torque from the tie bolt to the compressor stage in response to the shaft disconnect event. The aft-torque interface is configured to transmit the torque from the turbine stage to the tie bolt in response to the shaft disconnect event.

In some embodiments, the fore-torque interface includes a lug slot formed in one of the tie bolt and the compressor stage and a fore-drive lug coupled to the other of the tie bolt and the compressor stage. The fore-drive lug may be located in the lug slot to rotatably couple the compressor stage to the tie bolt.

In some embodiments, the aft-torque interface includes an aft-drive lug and a coupler ring. The aft-drive lug may be rotatably coupled to the turbine stage. The coupler ring may be rotatably coupled to the tie bolt and the coupler ring is formed to include a driven lug. The aft-drive lug may be configured to transmit at least a portion of the torque to the driven lug in response to the shaft disconnect event so that the torque is transmitted from the turbine stage through the coupler ring and to the tie bolt during the shaft disconnect event.

In some embodiments, the aft-drive lug extends axially away from the turbine stage toward the coupler ring. The driven lug may extend axially away from the coupler ring toward the aft-drive lug. The driven lug may be circumferentially aligned with the aft-drive lug.

In some embodiments, the compressor stage includes a hub arranged around the axis and a plurality of airfoils that extend radially away from the hub. The lug slot may be formed in the hub of the compressor stage and the fore-drive lug may be coupled to the tie bolt and located in the lug slot.

In some embodiments, the fail-safe system includes a pin. The pin may extend at least partway into the compressor stage and at least partway into the tie bolt to rotatably couple the compressor stage to the tie bolt.

In some embodiments, the fail-safe system includes an aft-torque interface that includes an aft-drive lug and a coupler ring. The aft-drive lug may be rotatably coupled to the turbine stage. The coupler ring may be rotatably coupled to the tie bolt. The coupler ring may be formed to include a driven lug and the driven lug is aligned circumferentially with the aft-drive lug.

According to another aspect of the present disclosure, a gas turbine engine includes an engine core, a tie bolt, and a fail-safe system. The engine core includes a compressor stage adapted to rotate about an axis, a turbine stage adapted to rotate about the axis, and a shaft that rotatably couples the compressor stage with the turbine stage for rotation with the turbine stage. The tie bolt locates the compressor stage axially relative to the turbine stage. The fail-safe system is configured to rotatably couple the compressor stage and the turbine stage to the tie bolt in response to a shaft disconnect event.

In some embodiments, the fail-safe system includes a fore-torque interface that includes a lug slot and a fore-drive lug. The lug slot may be formed in one of the tie bolt and the compressor stage. The fore-drive lug may be coupled to the other of the tie bolt and the compressor stage. The fore-drive lug may be located in the lug slot to rotatably couple the compressor stage to the tie bolt.

In some embodiments, the compressor stage includes a hub arranged around the axis and a plurality of airfoils that extend radially away from the hub. The lug slot may be formed in the hub of the compressor stage. The fore-drive lug may be coupled to the tie bolt and located in the lug slot.

In some embodiments, the fail-safe system includes an aft-torque interface that includes an aft-drive lug and a coupler ring. The aft-drive lug may be rotatably coupled to the turbine stage. The coupler ring may be rotatably coupled to the tie bolt and the coupler ring is formed to include a driven lug. The driven lug may be aligned circumferentially with the aft-drive lug.

In some embodiments, the aft-drive lug extends axially away from the turbine stage toward the coupler ring. The driven lug may extend axially away from the coupler ring toward the aft-drive lug. The driven lug may be circumferentially aligned with the aft-drive lug.

In some embodiments, the fail-safe system includes an aft-torque interface. The aft-torque interface may rotatably couple the turbine stage to the tie bolt in response to the shaft disconnect event.

In some embodiments, the fail-safe system includes a fore-torque interface. The fore-torque interface may include a pin that extends at least partway into the compressor stage and at least partway into the tie bolt to rotatably couple the compressor stage to the tie bolt.

In some embodiments, the fail-safe system includes an aft-torque interface that includes a coupler ring and a pin. The coupler ring may be configured to rotatably couple to the turbine stage. The pin may extend at least partway into the coupler ring and at least partway into the tie bolt to rotatably couple the coupler ring to the tie bolt.

According to another aspect of the present disclosure, a method may include a number of steps. The method may include applying a compressive force to a compressor stage and a turbine stage with a tie bolt, rotating the turbine stage about an axis, transmitting torque from the turbine stage through a shaft to the compressor stage to rotate the compressor stage about the axis, and transmitting the torque from the turbine stage through the tie bolt to the compressor stage to rotate the compressor stage about the axis in response to a shaft disconnect event in which the shaft no longer transmits the torque from the turbine stage to the compressor stage while the turbine stage is rotating.

In some embodiments, transmitting the torque from the turbine stage through the shaft to the compressor stage to rotate the compressor stage about the axis is performed without transmitting the torque from the turbine stage through the tie bolt to the compressor stage. In some embodiments, the method may include rotating the turbine stage relative to the tie bolt until the turbine stage is rotatably coupled to the tie bolt in response to the shaft disconnect event. In some embodiments, the method may include rotating the turbine stage at the same speed as the compressor stage during the shaft disconnect event.

These and other features of the present disclosure will become more apparent from the following description of the illustrative embodiments.

DETAILED DESCRIPTION OF THE DRAWINGS

Figure 1:
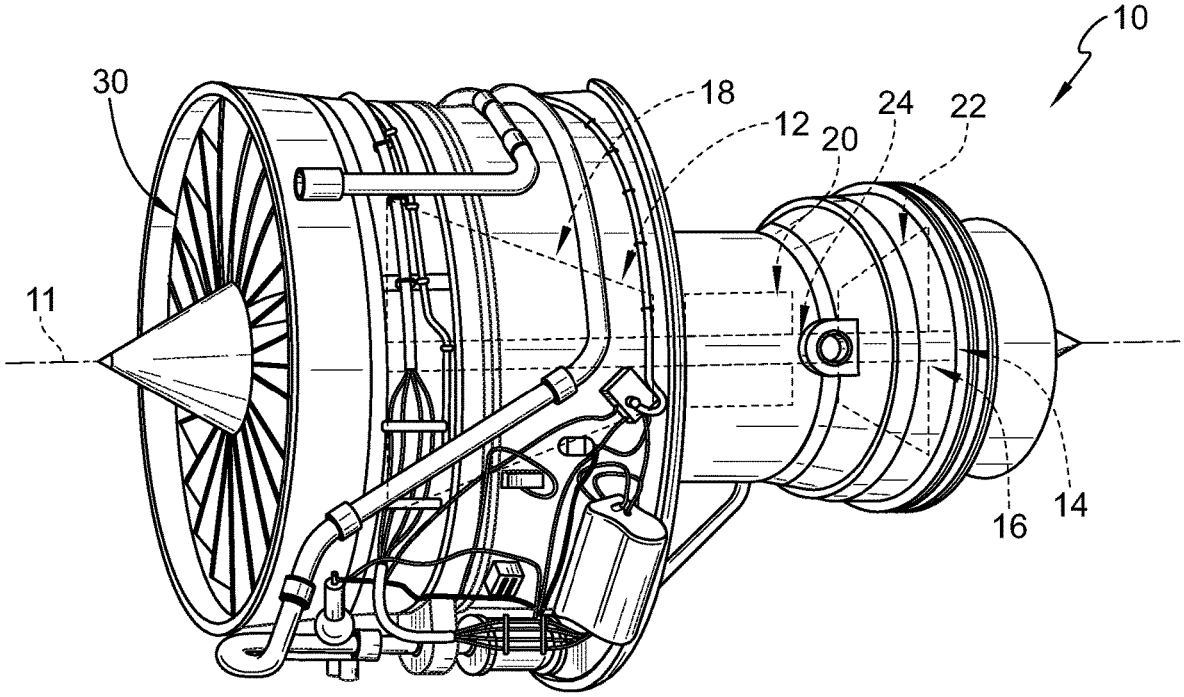
FIG. 1 is perspective view of a gas turbine engine that includes an engine core, a tie bolt, and a fail-safe system configured to transmit torque generated by the engine core through the tie bolt if the engine core experiences a shaft disconnect event.

For the purposes of promoting an understanding of the principles of the disclosure, reference will now be made to a number of illustrative embodiments illustrated in the drawings and specific language will be used to describe the same.

Figure 2:
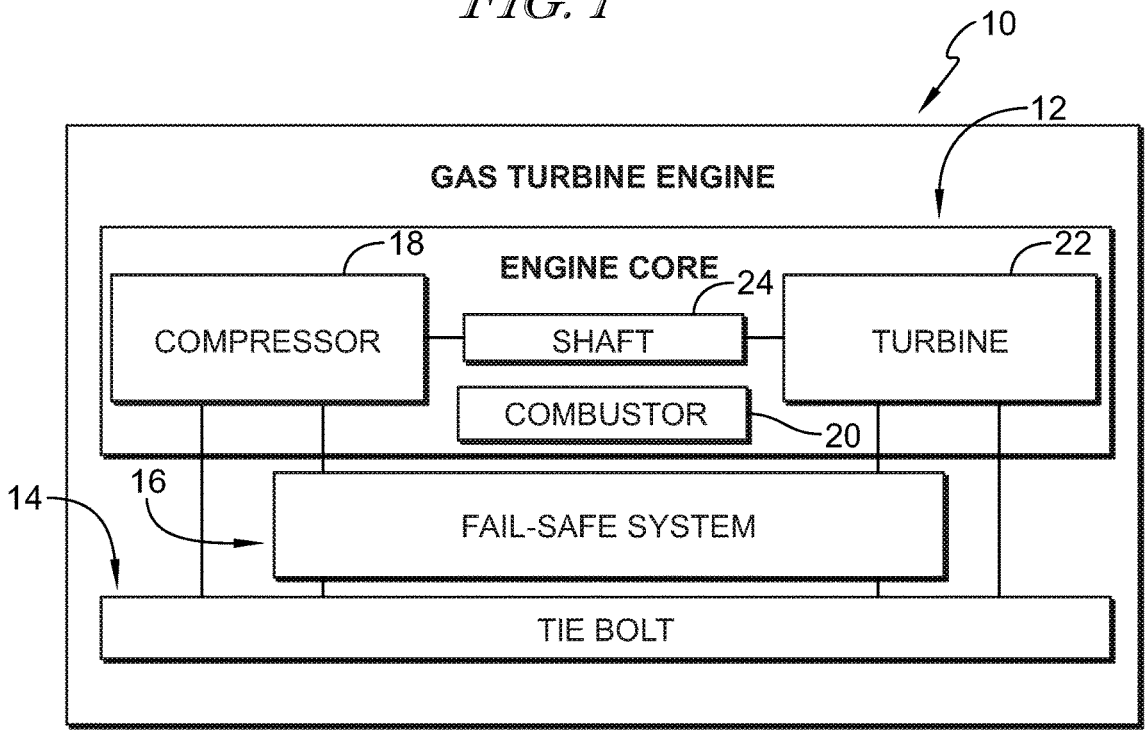
FIG. 2 is a diagrammatic view of the gas turbine engine of FIG. 1 showing that the engine core includes a compressor, a combustor, a turbine, and a shaft that couples the turbine with the compressor and suggesting that the fail-safe system is configured to transmit the torque from the turbine to the compressor through the tie bolt in response to a shaft disconnect event.

A gas turbine engine 10 in accordance with the present disclosure is shown in FIG. 1. The gas turbine engine includes an engine core 12 configured to produce mechanical energy, a tie bolt 14 configured to couple together components of the engine core 12, and a fail-safe system 16 as shown in FIG. 2. During normal operation of the gas turbine engine 10, torque is transmitted from a turbine 22 of the engine core 12 through a shaft 24 (or shafting) to a compressor 18 of the engine core 10. However, if the shaft 24 fails to transmit the torque, the fail-safe system 16 transmits the torque from the turbine 22 to the compressor 18 through the tie bolt 14 so that a resistive load remains applied to the turbine 22 instead of the turbine 22 being free to rotate faster than its designed limits (sometimes called overspeed).

The engine core 12 includes the compressor 18, a combustor 20, the turbine 22, and the shaft 24 as shown in FIG. 2. The compressor 18 compresses and delivers air to the combustor 20. The combustor 20 mixes fuel with the compressed air received from the compressor 18 and ignites the fuel. The hot, high-pressure gasses from the burning fuel are directed into the turbine 22 where the turbine 22 extracts work to produce the mechanical energy that drives the compressor 18 by transmitting torque through the shaft 24. The remaining energy of the gas stream may be extracted downstream of the turbine 22 and may further drive a fan 30, turboprop, driveshaft, gear box, etc.

The tie bolt 14 applies an axial compressive load to the compressor 18, the turbine 22, and the shaft 24 to couple together those components as suggested in FIG. 2. The compressor 18, turbine 22, and shaft 24 include interlocking features for transmitting the torque through the engine core 12. In normal operation of the gas turbine engine 10, the tie bolt 14 does not transfer torque. Instead, the interlocking features of the compressor 18, turbine 22, and shaft 24 transmit the torque through the engine core.

The fail-safe system 16 is configured to provide backup torque-transfer means for transmitting the torque from the turbine 22 to the compressor 18 through the tie bolt 14 in response to a shaft disconnect event in which the shaft 24 fails to transmit the torque from the turbine 22 to the compressor 18 during operation of the gas turbine engine 10 so that the turbine 22 is blocked from rotating faster than the compressor 18 during the shaft disconnect event. A shaft disconnect event may be detected, for example, by changes in vibration of the shaft 24 and engine core 12. The engine core 12 may be shut down in response to the shaft disconnect event and the fail-safe system 16 transmits the torque during the shut down.

Figure 3:
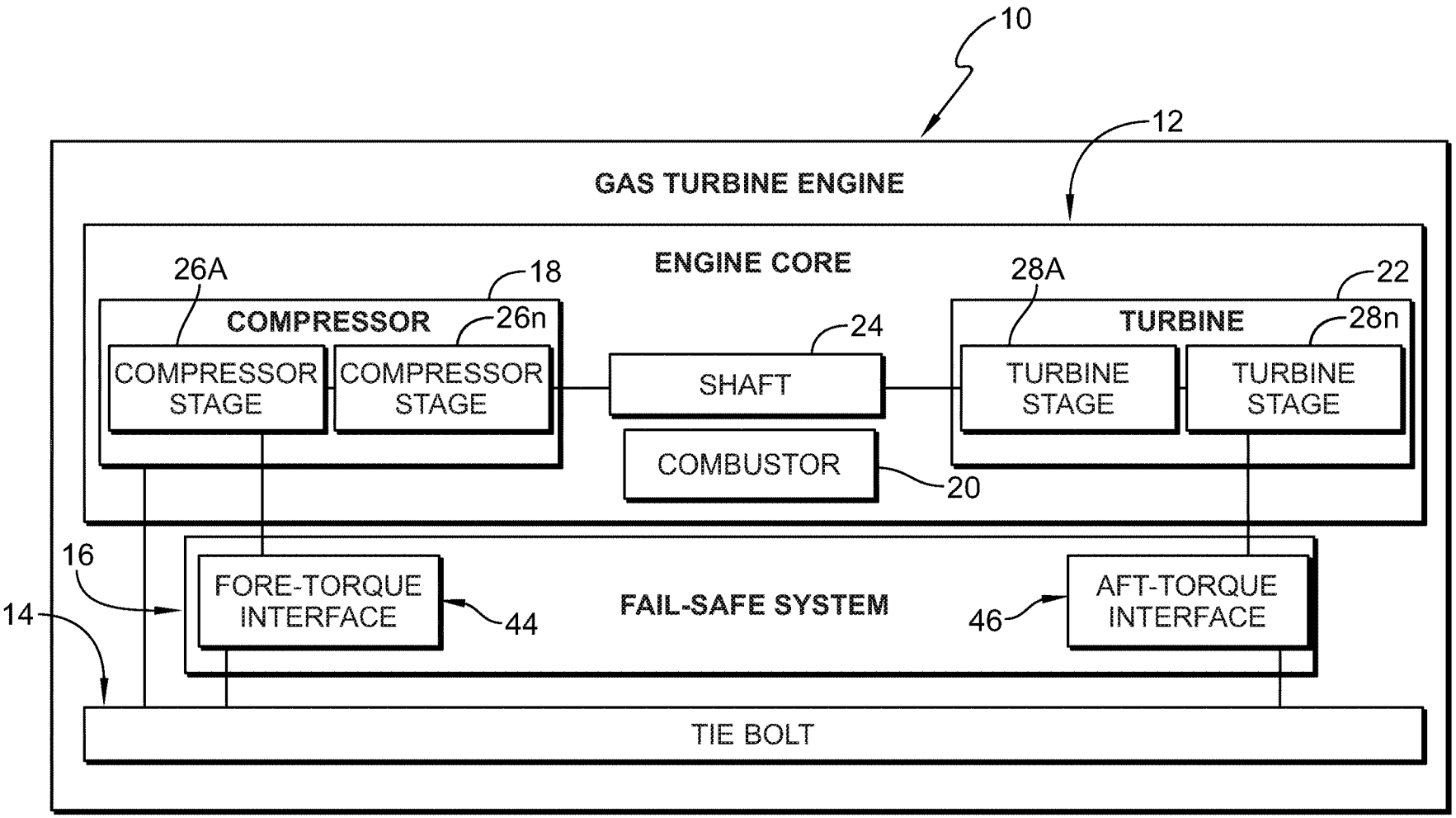
FIG. 3 is a diagrammatic view of the gas turbine engine of FIG. 1 showing that the compressor includes a plurality of stages, the turbine includes a plurality of stages, and the fail-safe system includes a fore-torque interface configured to couple the compressor stages with the tie bolt and an aft-torque interface configured to couple the turbine stages with the tie bolt.
Figure 4:
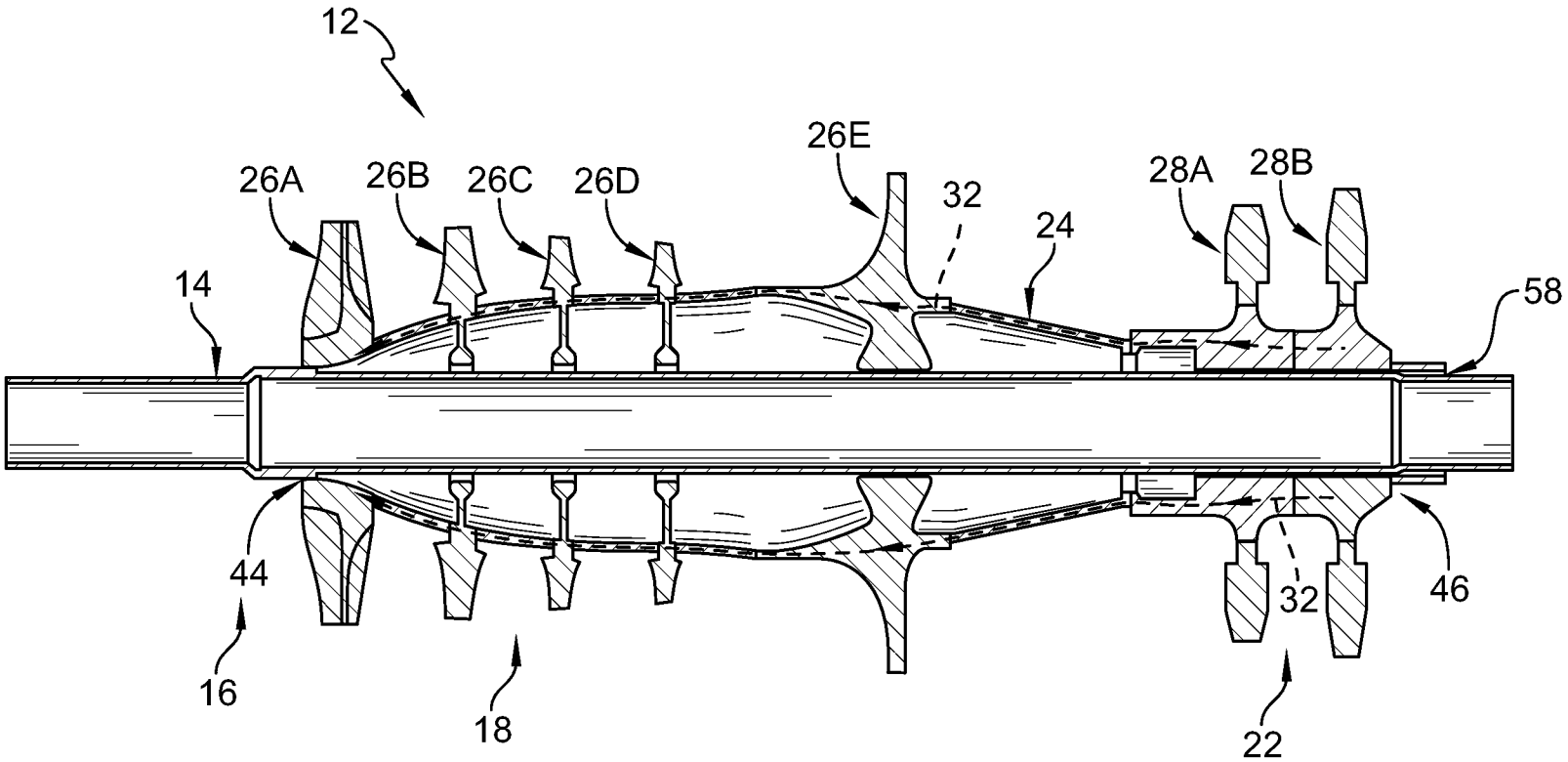
FIG. 4 is a section view of a portion of the gas turbine engine of FIG. 1 showing the engine core, tie bolt, and fail-safe system and suggesting that the torque is transmitted along a primary path from the turbine through the shaft of the engine core to the compressor and the tie bolt applies only an axial compression load to the turbine and compressor.

The illustrative compressor 18 includes a plurality of compressor stages 26A, 26B, 26C, 26D, 26E that are rotatably coupled together as shown in FIGS. 1-3. The illustrative compressor 18 includes a plurality of axial compressor stages 26A, 26B, 26C, and 26D and a centrifugal compressor stage 26E located downstream of the axial compressor stages 26A-26D as shown in FIG. 4. The type and number of compressor stages is variable and may be based on the performance design considerations of the gas turbine engine 10. The engine core 12 may include the compressor stage 26A and one or more of any combination of axial and centrifugal compressor stages 26*n* as suggested in FIG. 3.

Each compressor stage 26A-26E includes features for rotatably coupling adjacent stages so that the torque is transmitted between the compressor stages 26A-26E through the features during operation of the gas turbine engine 10. In the illustrative embodiment, the fore and aft faces of the compressor stages 26A-26E are splined and interlock with adjacent stages 26A-26E to form joints. The tie bolt 14 applies a compressive force to the compressor stages 26A-26E to maintain engagement of the interlocked joints between compressor stages 26A-26E. In other embodiments, the compressor stages 26A-26E may be bolted, pinned, fastened, meshed with teeth or tabs, or coupled for rotation to another compressor stage 26A-26E by any other suitable alternative means.

The turbine 22 includes a plurality of turbine stages 28A, 28B as shown in FIGS. 1-3. The first turbine stage 28A is a high-pressure turbine stage and the second turbine stage 28B is a lower-pressure turbine stage. The high-pressure turbine stage 28A is rotatably coupled with the lower-pressure turbine stage 28B. As suggested in FIG. 3, the number of turbine stages is variable and may be based on the performance design considerations of the gas turbine engine 10. The engine core 12 may include the turbine stage 28B and one or more turbine stages 28*n*. As one example, additional turbine stages 28*n* may be located downstream of turbine stage 28B and may be connected to separate spools so as to rotate relative to turbine stages 28A, 28B.

Each turbine stage 28A, 28B includes features for rotatably coupling adjacent stages so that the torque is transmitted between the turbine stages 28A, 28B through the features during operation of the gas turbine engine 10. In the illustrative embodiment, the fore and aft faces of the turbine stages 28A, 28B are splined and interlock with each other to form joints. The tie bolt 14 applies a compressive force to the turbine stages 28A, 28B to maintain engagement of the interlocked joints between the turbine stages 28A, 28B. In other embodiments, the turbine stages 28A, 28B may be bolted, pinned, fastened, meshed with teeth or tabs, or coupled for rotation to each other by any other suitable alternative means.

The shaft 24 rotatably couples the turbine stage 28A with the compressor stage 26E to rotatably couple the turbine 22 with the compressor 18 as shown in FIG. 4. As a result, the torque is transmitted from the turbine 22 through the shaft 24 to the compressor 18 via the primary path 32 during normal operation of the gas turbine engine 10 as suggested in FIG. 4. As such, the turbine stage 28B is rotatably coupled with the compressor stage 26A during normal operation of the gas turbine engine 10. The primary path 32 includes transmitting torque in the fore direction from the first and second turbine stages 28A, 28B to the shaft 24, from the shaft 24 to the compressor stage 26E, and from the compressor stage 26E to the other compressor stages 26A-26D.

The shaft 24 may directly couple the turbine 22 to the compressor 18 as shown in FIG. 4. In other embodiments, the shaft 24 may include multiple or intermediate parts that interconnect the turbine 22 and the compressor 18. The shaft 24 may be a separate component relative to the turbine stages 28A, 28B and the compressor stages 26A-26E as shown in FIG. 4. In other embodiments, the shaft 24 may be integrally formed with a compressor stage 26A-26E or a turbine stage 28A, 28B.

Figure 5:
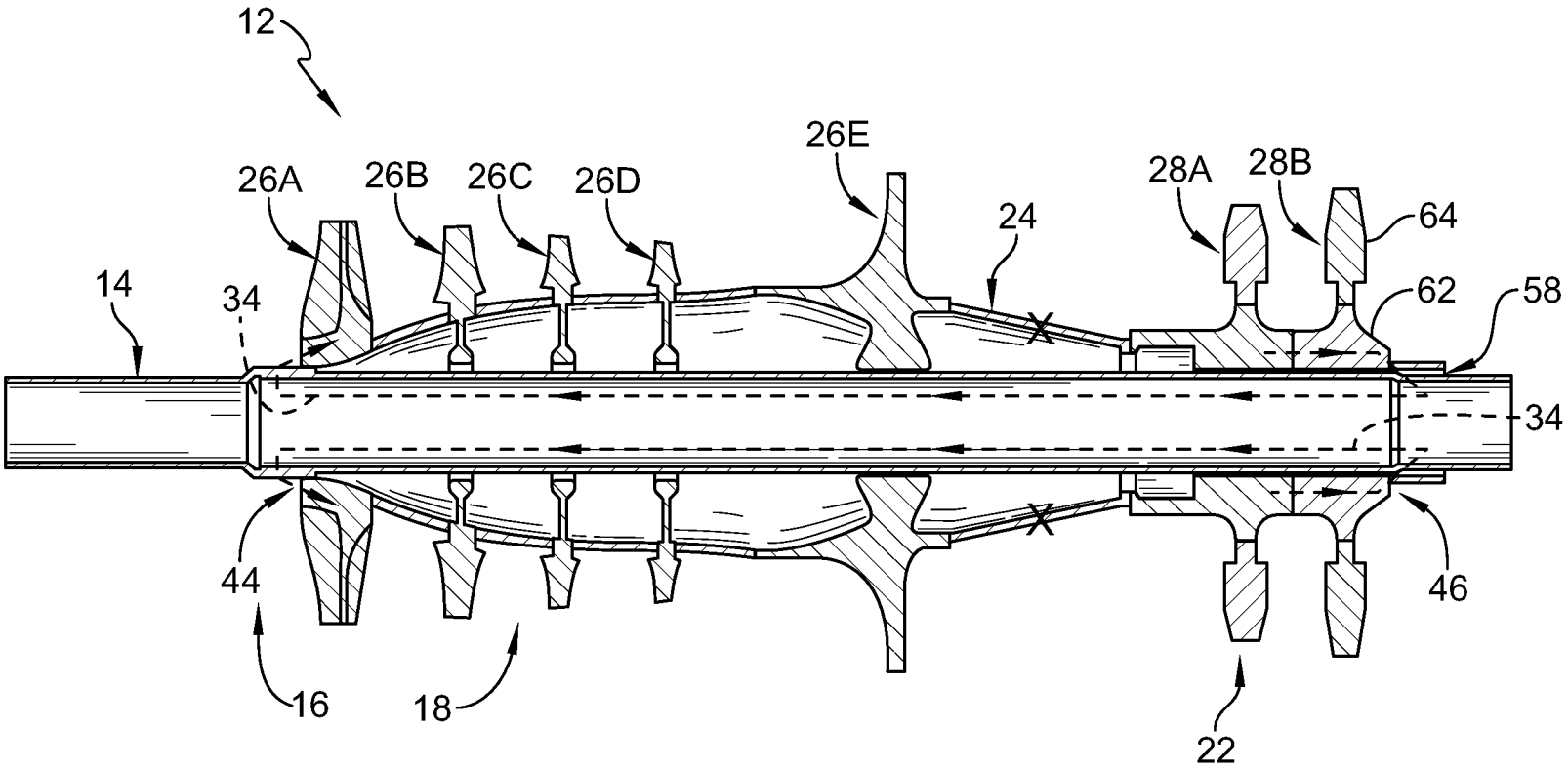
FIG. 5 is a section view similar to FIG. 4 showing the engine core, tie bolt, and fail-safe system and suggesting that a shaft disconnect event has occurred and, as a result, the torque is transmitted along an alternative path from the turbine through the fail-safe system and the tie bolt to the compressor.

The tie bolt 14 is coupled with the compressor stage 26A and the turbine stage 28B as shown in FIG. 5. The tie bolt 14 applies the compressive force to the compressor stages 26A-26E and the turbine stages 28A, 28B to maintain the torque transmitting joints between the stages 26A-26E and 28A, 28B. In other embodiments, the tie bolt 14 may be coupled directly to other components while still applying the compressive force to the compressor stages 26A-26E and the turbine stages 28A, 28B. The compressor 18, the turbine 22, and the shaft 24 are arranged circumferentially around the tie bolt 14.

The compressive force applied to the compressor stages 26A-26E and the turbine stages 28A, 28B by the tie bolt 14 is not sufficient to generate a friction force that would allow the torque to be transmitted from the turbine stage 28B to the compressor stage 26A through the tie bolt 14. That is, without the fail-safe system 16, the turbine stage 28A and/or the compressor stage 26A would slip relative to the tie bolt 14 if attempting to transmit the torque through the friction connection of the tie bolt 14.

The fail-safe system 16 is configured to provide backup torque-transfer means for transmitting the torque from the turbine stage 28B to the compressor stage 26A through the tie bolt 14 in response to a shaft disconnect event in which the shaft 24 fails to transmit the torque from the turbine stage 28B to the compressor stage 26A during operation of the gas turbine engine 10 so that the turbine stage 28B is blocked from rotating about the axis 11 faster than the compressor stage 26A during the shaft disconnect event. The fail-safe system 16 is configured to transmit the torque via an alternative path 34. The alternative path 34 includes transmitting the torque from the first turbine stage 28A to the second turbine stage 28B, from the second turbine stage 28B to the tie bolt 14 via a coupler ring 58, and from the tie bolt 14 to the compressor stage 26A as shown in FIG. 5.

Figure 6:
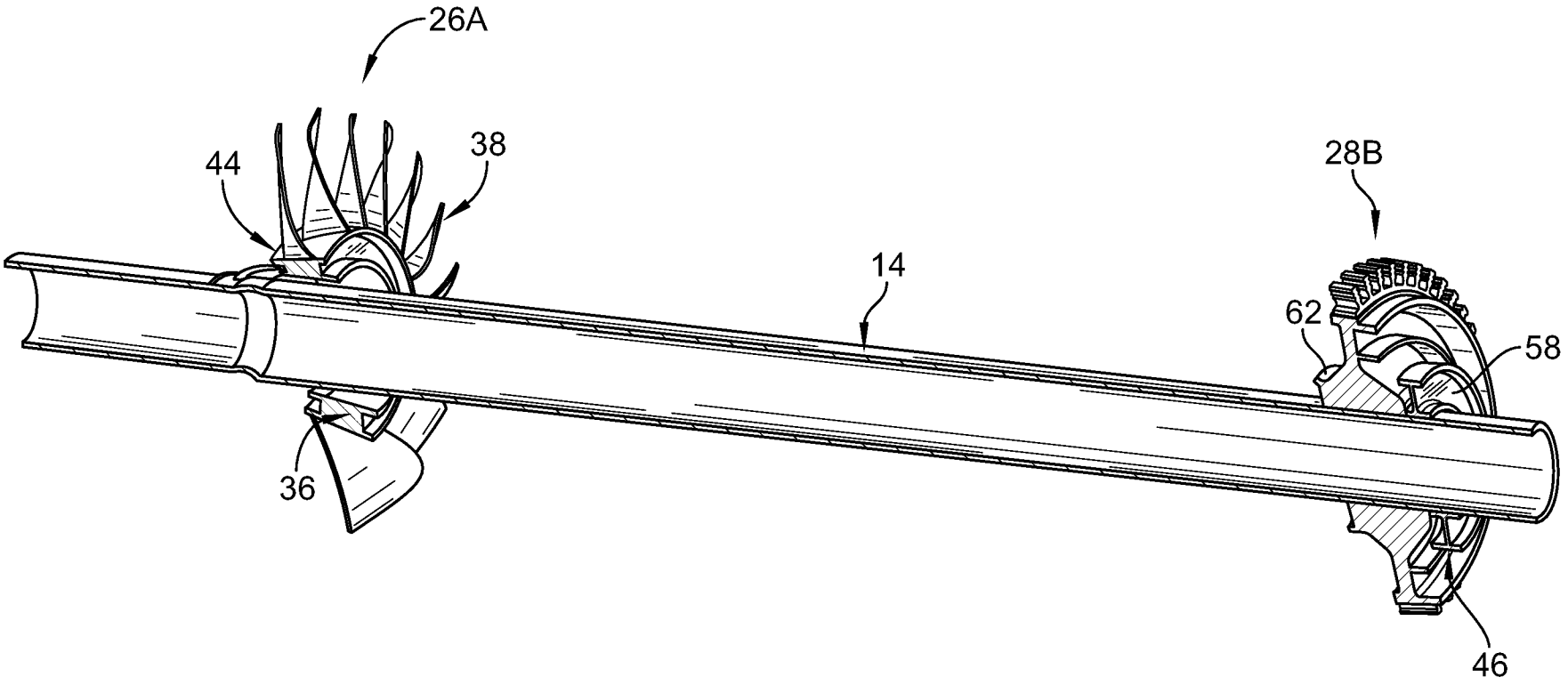
FIG. 6 is a cutaway view showing a portion of one compressor stage included in the compressor, one turbine stage included in the turbine, the tie bolt, and the fail-safe system and suggesting that the fail-safe system and the tie bolt couple the turbine stage and the compressor stage together during a shaft disconnect event.

The fail-safe system 16 includes a fore-torque interface 44 and an aft-torque interface 46 as shown in FIGS. 3 and 6. The fore-torque interface 44 is configured to rotatably couple the tie bolt 14 to the compressor stage 26A of the compressor 18 during a shaft disconnect event. The aft-torque interface 46 is configured to rotatably couple the tie bolt 14 to the turbine stage 28B of the turbine 22 during a shaft disconnect event.

Figure 7:
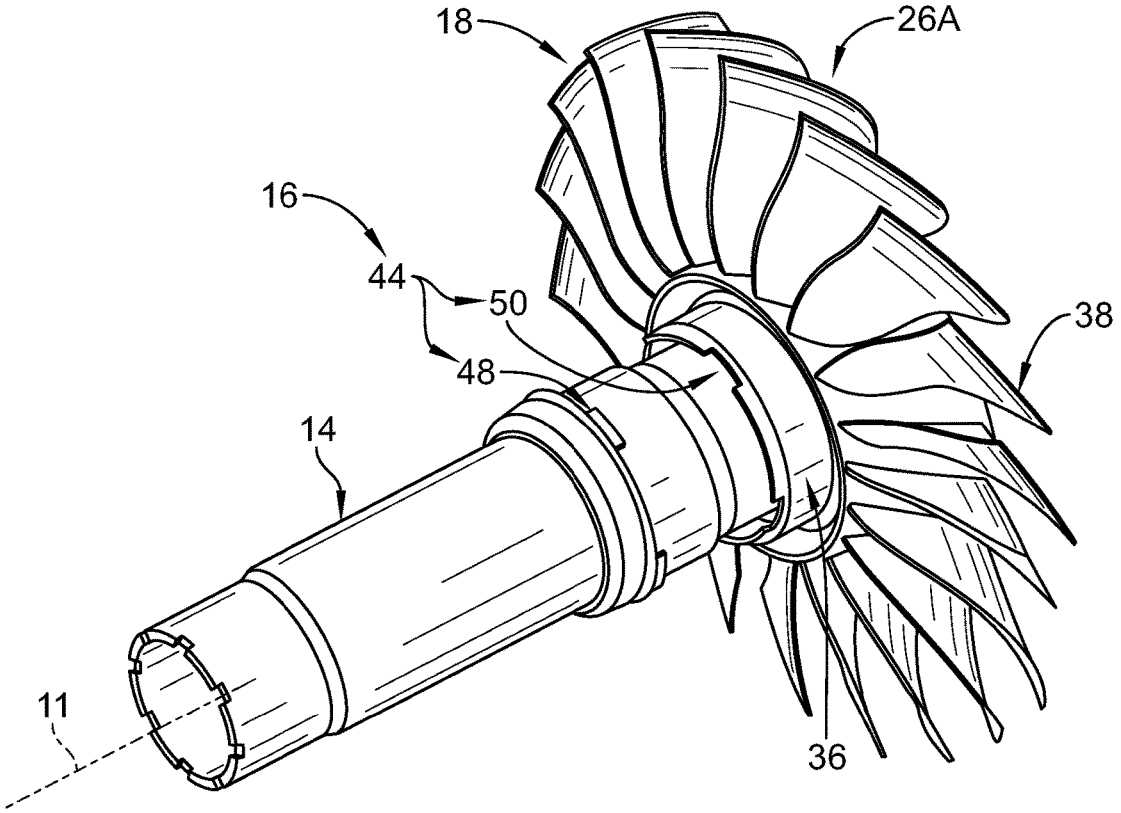
FIG. 7 is a perspective view of the compressor stage, tie bolt, and fore-torque interface of the fail-safe system showing that the fore-torque interface includes drive lugs coupled to the tie bolt and lug slots formed in the compressor stage.
Figure 8:
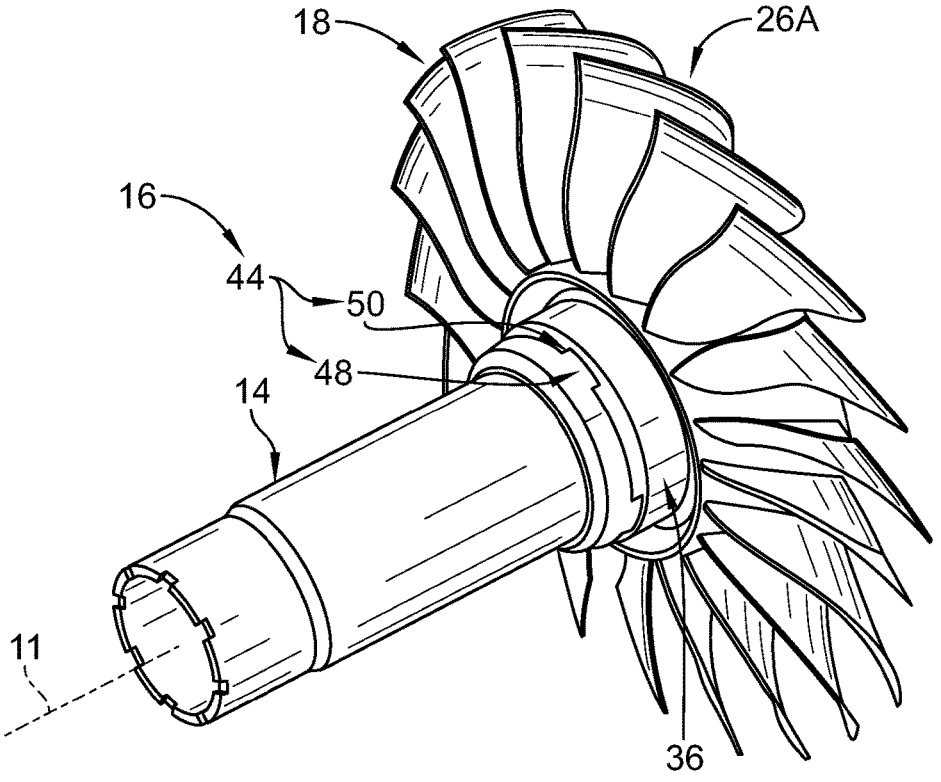
FIG. 8 is a perspective view similar to FIG. 7 showing the drive lugs included in the fore-torque interface located in the lug slots formed in the compressor stage to rotatably couple the tie bolt with the compressor stage.

The fore-torque interface 44 includes fore-drive lugs 48 coupled to the tie bolt 14 and lug slots 50 formed in the compressor stage 26A as shown in the exploded view of FIG. 7. The fore-drive lugs 48 are rotatably coupled to the tie bolt 14 and extend radially outward away from the tie bolt 14 relative to the axis 11. The compressor stage 26A includes a compressor hub 36 and a plurality of compressor blades 38 that extend radially away from the compressor hub 36. The lug slots 50 are formed in the compressor hub 36 as shown in FIG. 7. After assembly of the gas turbine engine 10, each fore-drive lug 48 is located in a corresponding lug slot 50 to rotatably couple the tie bolt 14 to the compressor stage 26A as shown in FIG. 8.

The fore-drive lugs 48 transmit the torque from the tie bolt 14 to the compressor hub 36 during a shaft disconnect event as suggested in FIG. 5. The fore-drive lugs 48 do not transmit the torque from the tie bolt 14 to the compressor hub 36 during normal operation as suggested in FIG. 4.

The fore-drive lugs 48 include a plurality of lugs 48 as shown in FIG. 7. In other embodiments, the fore-torque interface 44 includes a single fore-drive lug 48. The fore-drive lugs 48 each extend circumferentially partway about the axis 11. The fore-drive lugs 48 are integrally formed with the tie bolt 14 in the illustrative embodiment. In other embodiments, the fore-torque interface 44 includes one or more intermediate components configured to rotatably couple the tie bolt 14 to the compressor stage 26A during a shaft disconnect event.

Figure 12:
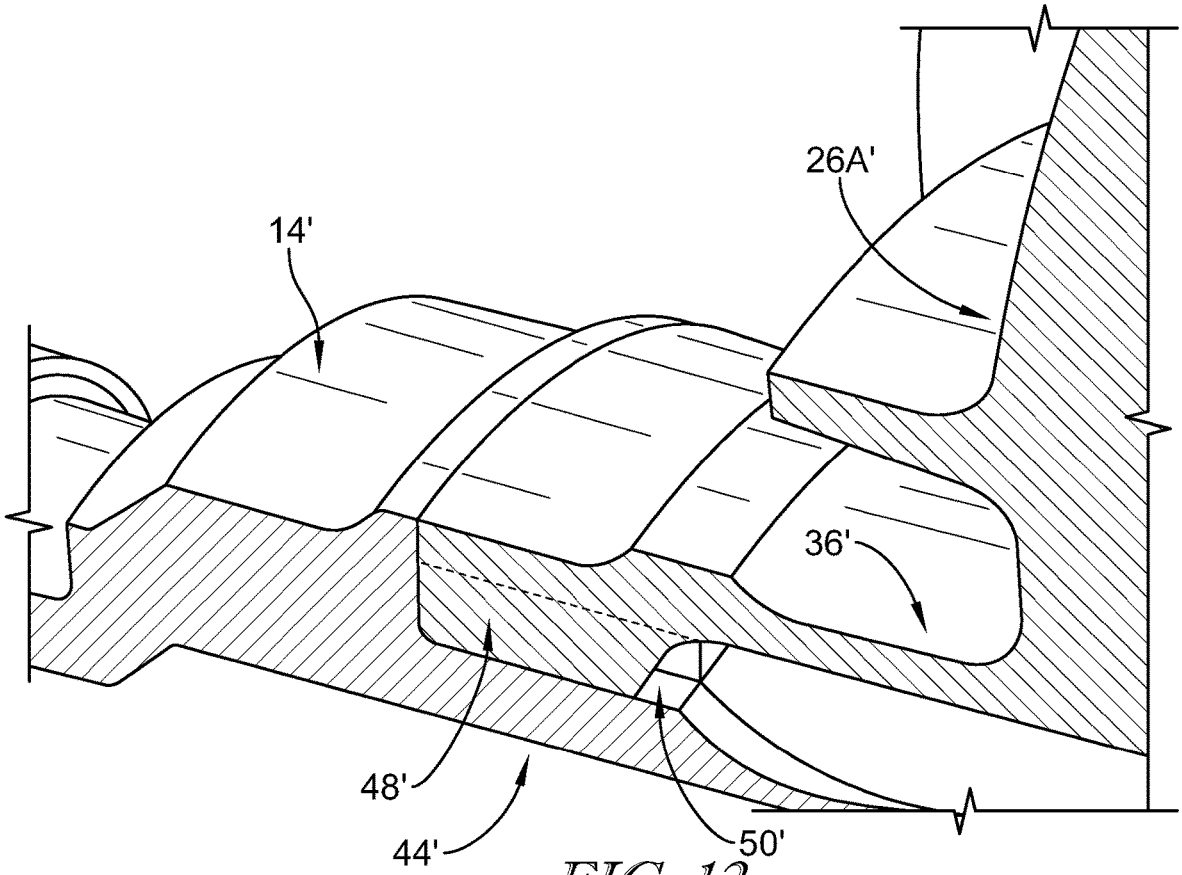
FIG. 12 is a section and perspective view of another embodiment of the fore-torque interface showing that the tie bolt includes a lug slot and the compressor stage includes a lug located in the lug slot to rotatably couple the compressor stage with the tie bolt.
Figure 13:
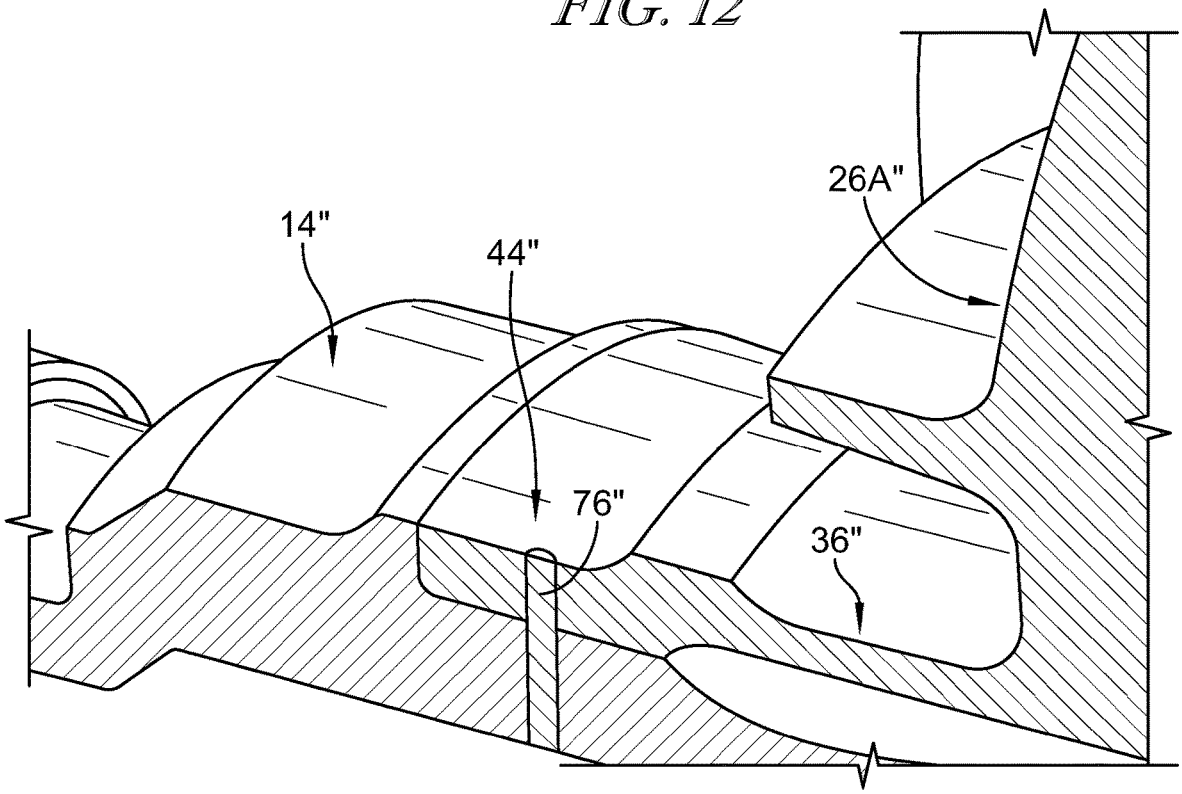
FIG. 13 is a section and perspective view of another embodiment of the fore-torque interface showing that the fore-torque interface includes a pin that extends into the compressor stage and the tie bolt to rotatably couple the compressor stage with the tie bolt.

In other embodiments, the fore-torque interface 44 rotatably couples the tie bolt 14 to the compressor stage 26A via other suitable means such as, for example, lugs formed on the compressor stage 26A and pins that are located in the compressor stage 26A and tie bolt 14 as shown in FIGS. 12 and 13. For example, FIG. 12 shows another embodiment of a compressor stage 26A' and a tie bolt 14' in which the fore-torque interface 44' includes fore-drive lugs 48' coupled to the compressor hub 36' that are located in lug slots 50' formed in the tie bolt 14' to rotatably couple the tie bolt 14' to the compressor 26A'. FIG. 13 shows another embodiment of a compressor stage 26A" and a tie bolt 14" in which a fore-torque interface 44" includes a pin 76" that extends into the compressor hub 36" and the tie bolt 14" to rotatably couple the tie bolt 14" to the compressor stage 26A". In other embodiments, the fore-torque interface 44 includes intermediate components that couple the tie bolt 14 to the compressor stage 26A such as, for example, a component like the coupler ring 58.

Figure 9:
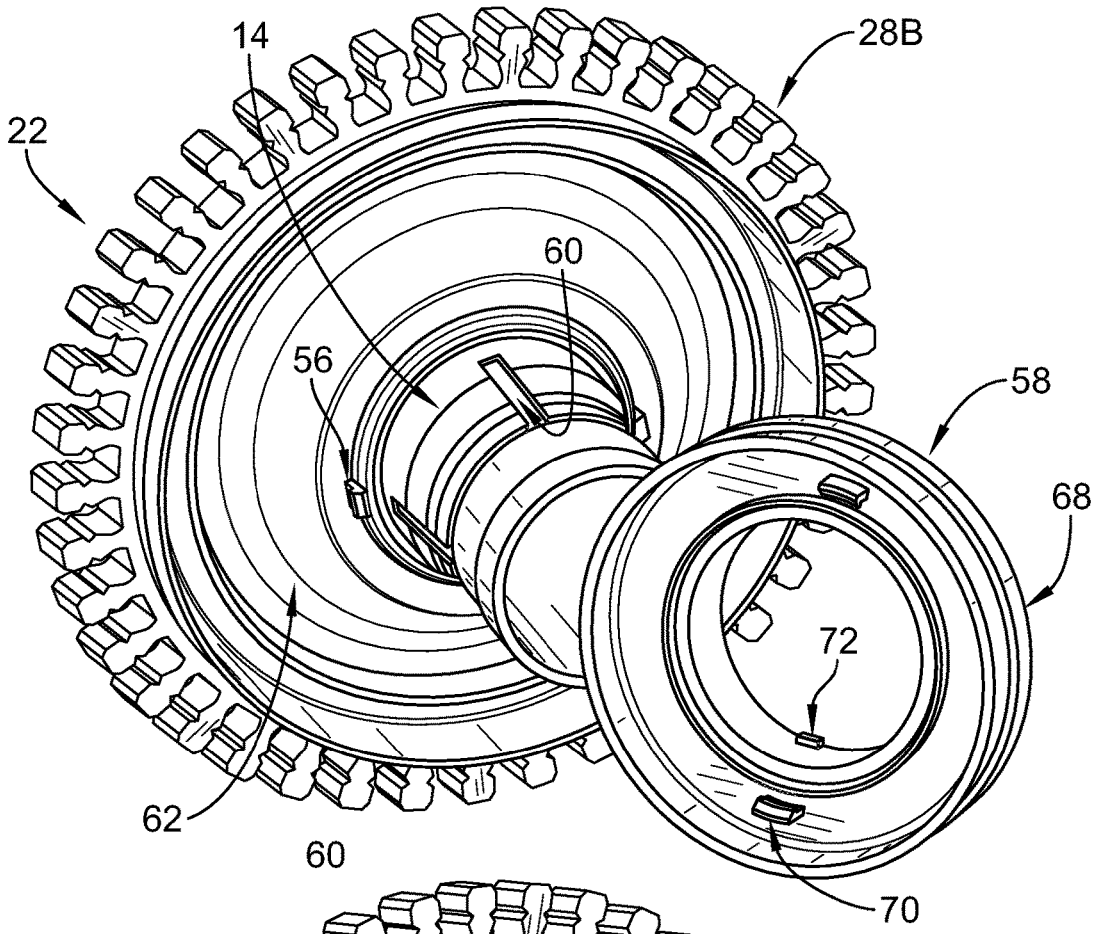
FIG. 9 is a perspective view of the turbine stage, tie bolt, and aft-torque interface of the fail-safe system showing that the aft-torque interface includes a coupler ring and lugs coupled to the turbine stage and the coupler ring such that the coupler ring is configured to transmit torque between the turbine stage and the tie bolt during a shaft disconnect event.
Figure 10:
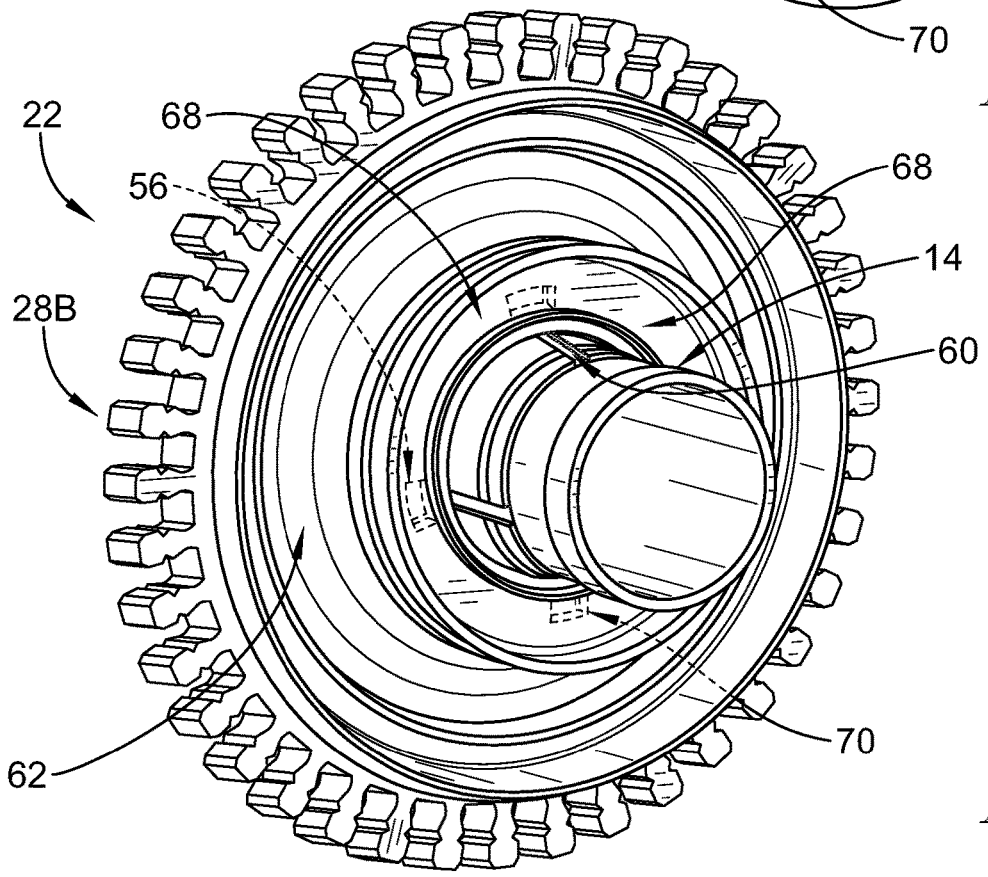
FIG. 10 is a perspective view similar to FIG. 9 showing that the coupler ring included in the aft-torque interface of the fail-safe system is rotatably coupled with the tie bolt and that the lugs coupled to the coupler ring and the turbine stage are circumferentially aligned so that the coupler ring may rotatably couple with the turbine stage to transmit the torque between the turbine stage and the tie bolt.
Figure 11:
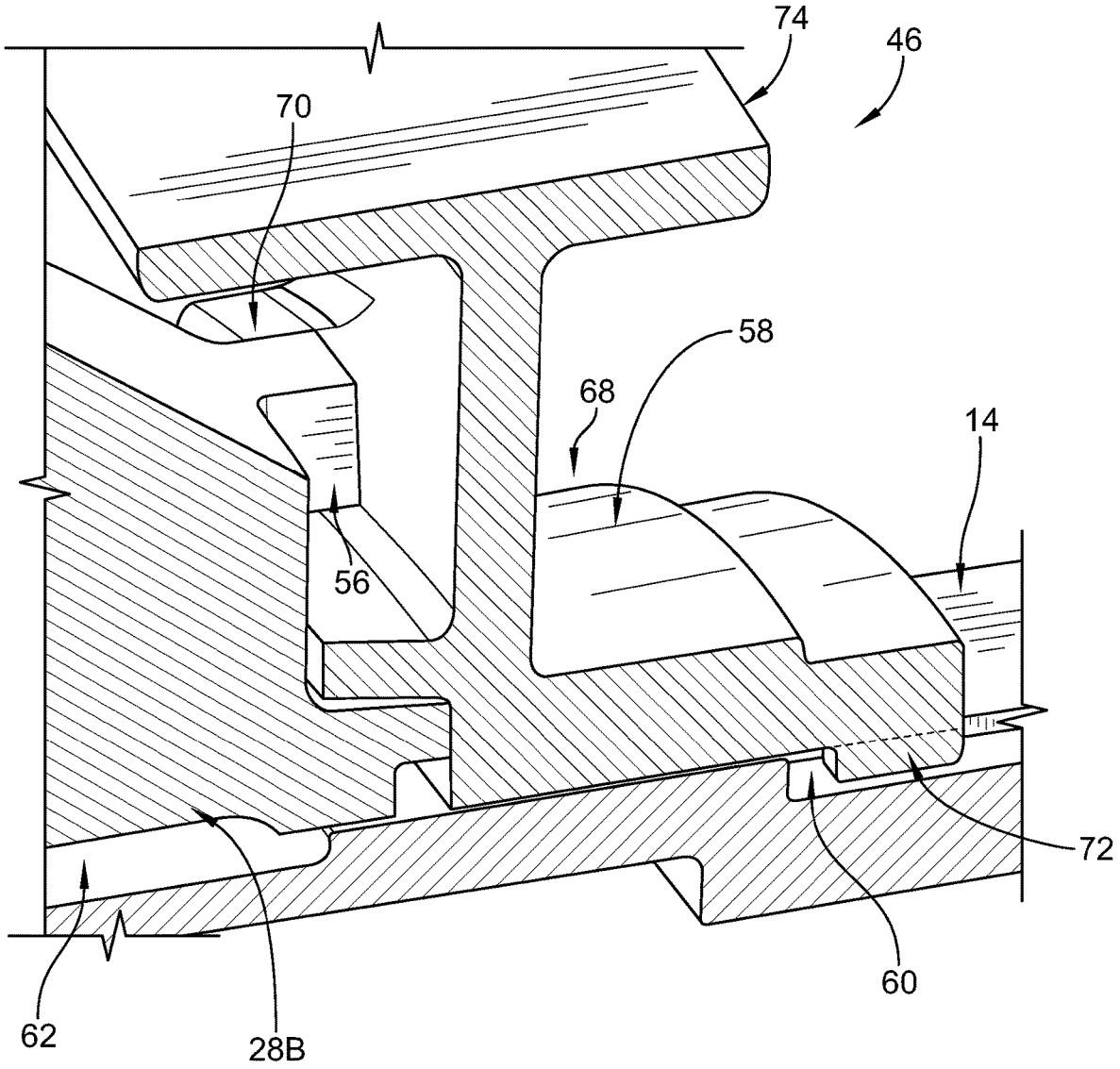
FIG. 11 is section and perspective view of the turbine stage, aft-torque interface, and tie bolt showing that the lugs coupled to the turbine stage and the coupler ring are engaged to transmit torque and the coupler ring includes a rib received in a slot of the tie bolt to rotatably couple the coupler ring with the tie bolt.

The aft-torque interface 46 includes aft-drive lugs 56 coupled to the turbine stage 28B, the coupler ring 58, and slots 60 formed in the tie bolt 14 as shown in FIGS. 9-11. The coupler ring 58 is received in the slots 60 to rotatably couple the coupler ring 58 to the tie bolt 14 as shown in FIG. 11. The aft-drive lugs 56 are configured to transmit the torque to the coupler ring 58 and, thus, to the tie bolt 14 during a shaft disconnect event. The aft-drive lugs 56 transmit the torque from the turbine stage 28B to the coupler ring 58 and the coupler ring 58 transmits the torque to the tie bolt 14 during a shaft disconnect event as suggested in FIG. 5. The aft-torque interface 46 does not transmit the torque from the turbine stage 28B to the tie bolt 14 during normal operation as suggested in FIG. 4.

The turbine stage 28B includes a turbine hub 62 and a plurality of turbine blades 64 that extend radially away from the turbine hub 62 as shown in FIGS. 5 and 9. The aft-drive lugs 56 included in the aft-torque interface 46 are rotatably coupled to the turbine hub 62 and extend axially outward and aft away from the turbine hub 62 relative to the axis 11. The aft-drive lugs 56 each extend partway around the axis 11. The aft-drive lugs 56 are integrally formed with the turbine stage 28B in the illustrative embodiment. The aft-drive lugs 56 include a plurality of lugs 56 as shown in FIG. 9. In other embodiments, the aft-torque interface 46 includes a single aft-drive lug 56.

The coupler ring 58 includes an annular body 68 arranged around the axis 11, driven lugs 70 that extend axially away from the annular body 68 and toward the turbine stage 28B, and ribs 72 that extend radially away from the annular body 68 and interlock with the tie bolt 14 as shown in FIGS. 9-11. In the illustrative embodiment, the coupler ring 58 further includes a sealing member 74 configured to provide a seal between the coupler ring 58 and a component of the gas turbine engine 10.

Each driven lug 70 is spaced apart circumferentially from a neighboring driven lug 70 as shown in FIG. 9. The driven lugs 70 extend circumferentially partway around the axis 11. The driven lugs 70 and the aft-drive lugs 48 overlap in the axial direction and the driven lugs 70 are aligned circumferentially with the aft-drive lugs 56. As such, the aft-drive lugs 56 are configured to engage the driven lugs 70 so that the torque may be transmitted from the aft-drive lugs 56 to the driven lugs 70. In other embodiments, intermediate components may be used to transmit the torque from the aft-drive lugs 56 to the driven lugs 70.

The aft-drive lugs 56 and the driven lugs 70 are shown as being spaced apart circumferentially during normal operation as shown in FIG. 10. In response to a shaft disconnect event, the turbine stage 28B and the tie bolt 14 will rotate about the axis 11 relative to one another until the aft-drive lugs 56 and the driven lugs 70 engage one another to cause the turbine stage 28B to rotate with the tie bolt 14 and transmit the torque to the tie bolt 14. In other embodiments, the aft-drive lugs 56 and the driven lugs 70 may be touching during normal operation without transmitting the torque from the turbine stage 28B to the coupler ring 58 and the tie bolt 14.

The rib slots 60 are formed in the tie bolt 14 as shown in FIGS. 9 and 11. After assembly of the gas turbine engine 10, each rib 72 included in the coupler ring 58 is located in a corresponding rib slot 60 to rotatably couple the coupler ring 58 to the tie bolt 14 as shown in FIG. 11.

Figure 14:
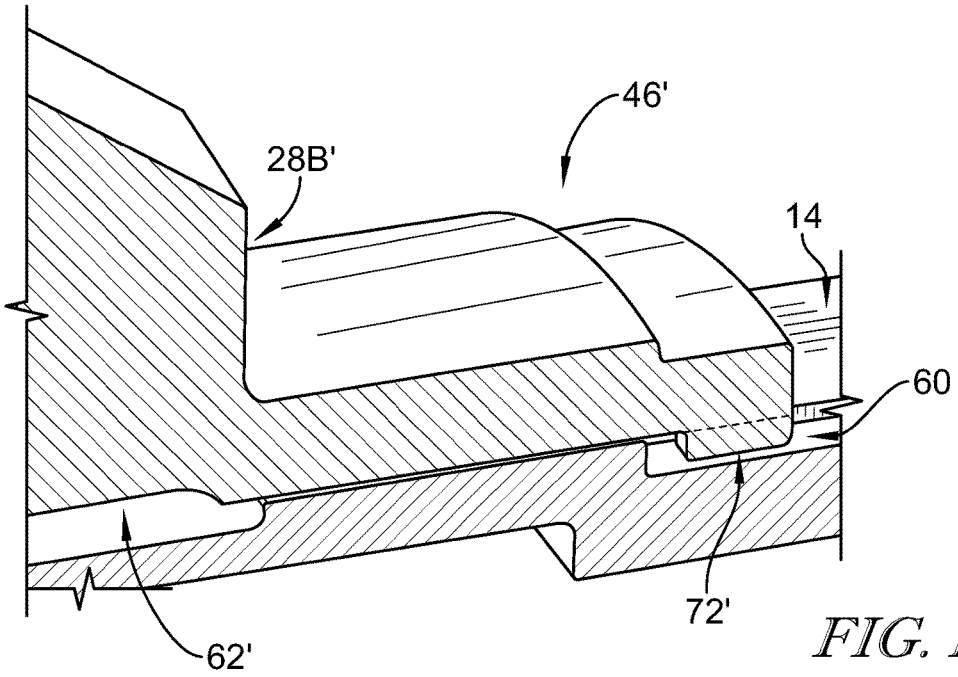
FIG. 14 is a section and perspective view of another embodiment of the aft-torque interface showing that the aft-torque interface includes a slot formed in the tie bolt and a rib coupled to the turbine stage and located in the slot such that the turbine stage is rotatably coupled directly with the tie bolt.
Figure 15:
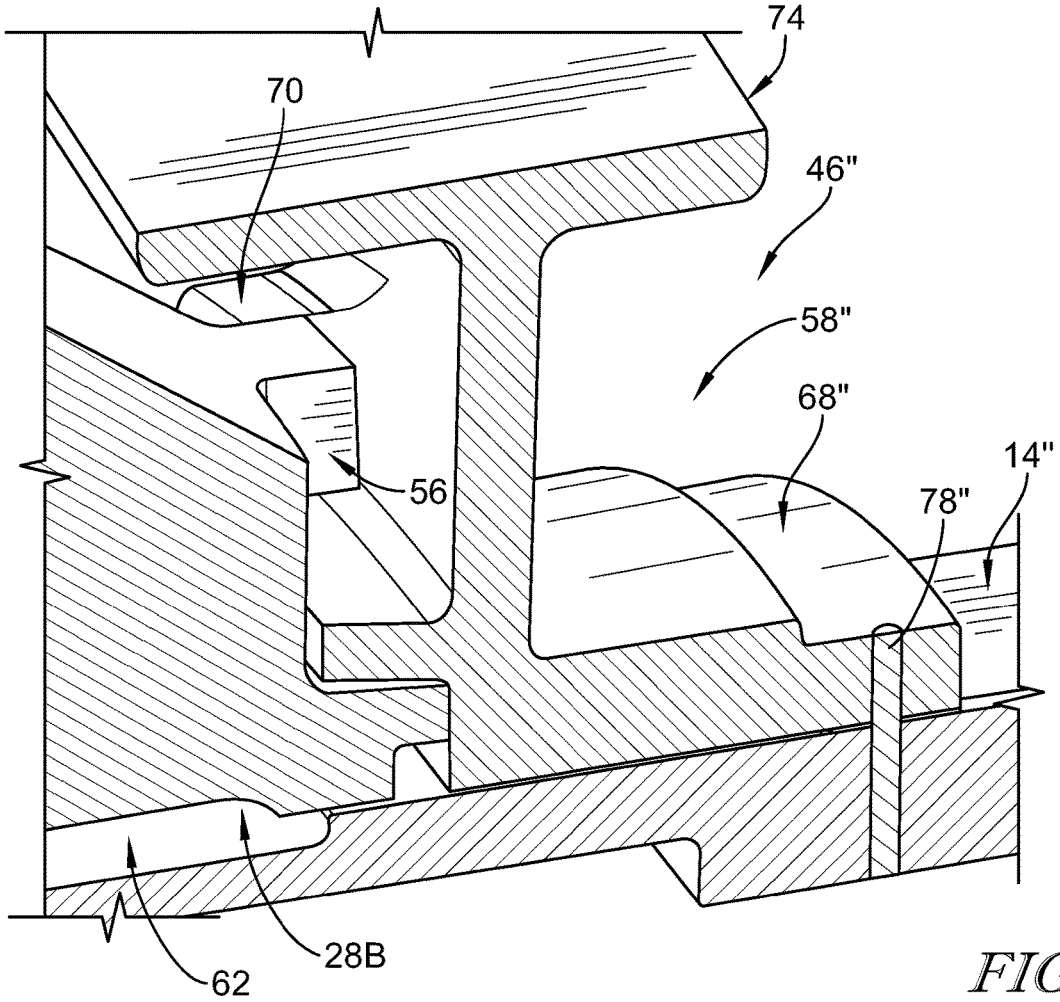
FIG. 15 is a section and perspective view of another embodiment of the aft-torque interface showing that the aft-torque interface includes a pin that extends into the coupler ring and the tie bolt to rotatably couple the coupler ring with the tie bolt.

In other embodiments, the aft-torque interface 46 rotatably couples the tie bolt 14 to the turbine stage 28B via other suitable means such as, for example, lugs or ribs coupled to one of the turbine stage 28B and the tie bolt 14 and slots or lugs formed in the other of the turbine stage 28B and the tie bolt 14 or pins that are located in the turbine stage 28B or coupler ring 58 and the tie bolt 14 as shown in FIGS. 14 and 15. FIG. 14 shows an embodiment of an aft-torque interface 46' in which the coupler ring 58 is omitted and the aft-torque interface 46' includes ribs 72' that are coupled to a turbine hub 62' of a turbine stage 28B'. The ribs 72' are located in the slots 60 formed in the tie bolt 14 to rotatably couple the turbine stage 28B' to the tie bolt 14. FIG. 15 shows another embodiment of an aft-torque interface 46" in which the ribs 72 and the slots 60 are omitted and a pin 78" extends through an annular body 68" of a coupler ring 58" and into a tie bolt 14".

During normal operation, the tie bolt 14 applies the compressive force to the compressor 18 and the turbine 22 as suggested in FIG. 4. The turbine 22 extracts work from the combustion products and transmits the torque from the turbine 22 through the shaft 24 to the compressor 18 along the primary path 32 as shown in FIG. 4.

In response to a shaft disconnect event, the torque is transmitted from the turbine 22 to the compressor 18 via the alternative path 34 as suggested in FIG. 5. In response to a shaft disconnect event, the turbine stage 28B may rotate relative to the tie bolt 14 and coupler ring 58 until the aft-drive lugs 56 and the driven lugs 70 engage as suggested in FIG. 11. The aft-drive lugs 56 transmit the torque to the coupler ring 58 through the driven lugs 70. The coupler ring 58 transmits the torque to the tie bolt 14 through the ribs 72. The tie bolt 14 transmits the torque to the compressor stage 26A through the fore-drive lugs 48. The compressor stage 26A transmits the torque to the other compressor stages 26B-26E. As a result, the turbine 22 remains loaded and the torque is transmitted to the compressor 18 during the shaft disconnect event. The tie bolt 14 applies the compressive force to the turbine 22 and the compressor 18 during the shaft disconnect event.

The present disclosure relates to the mechanical features and arrangement that allow power from the turbine 22 to be conveyed to the compressor 18 of the gas turbine engine 10 via an alternate torque path in the event of failure of the primary path 32 as suggested in FIGS. 4 and 5. The compressor stages 26A-26E, turbine stages 28A, 28B, and interconnecting shafts may be connected by a number of joints such as, for example friction joints or splined joints. The joints are the primary means of torque transmission from the turbine 22 to compressor 18 during operation of the gas turbine engine 10. A central tie bolt 14 running the length of the engine core 12 provides the compressive load for maintaining the position of the rotor components and proper engagement of these joints.

The rotor arrangement and the torque path from the turbine 22 to the compressor 18 under typical circumstances are shown in FIG. 4. In typical operation, the tie bolt 14 does not transfer torque, but provides only clamp load. In the event of shaft disconnect, where the primary torque path 32 from the turbine 22 to the compressor 18 is lost, the tie bolt 14, compressor stage 26A, turbine stage 28B, and coupler ring 58 possess mechanical features that engage to transfer torque from the turbine 22 to the compressor 18.

The alternate torque path 34 is configured to prevent the unloading and subsequent potential overspeed burst of the turbine 22 in the event of a shaft disconnect. A shaft break which uncouples the turbine 22 from the compressor 18, but do not dislocate the turbine rotors 28A, 28B (i.e., rotating to static clashing may not occur between the turbine rotors and static components such as turbine vanes) may result in turbine overspeed. Acceleration of the uncoupled, free-spinning turbine 22 may be too great for an overspeed control system to mitigate. The present disclosure is configured to prevent this from happening.

One embodiment of the mechanical features that create the alternate torque path 34 is shown in FIGS. 5 and 7-11. The path that the torque takes is described in the following sequence: primary shafting 24 fails (loses ability to transmit torque and failure may be annunciated by high vibration or performance shift), the turbine stage 28B rotationally slips until the turbine drive lugs 56 engage the lugs 70 on the coupler ring 58, the torque travels through the coupler ring 58 to the ribs 72 engaged with slots 60 in the tie bolt 14, the tie bolt 14 transfers the torque forward along its length to the drive lugs 48 at the forward end of the tie bolt 14, the drive lugs 48 on the tie bolt 14 transfer torque to slots in the compressor stage 26A, the torque is transferred from the compressor stage 26A to other compressor stages 26B-26E via the existing joints, and the turbine 22 and the compressor 18 remain connected during the disconnect event, allowing engine shutdown.

Rotatably coupled components are mechanically connected to rotate with one another at the same rotational speed about the axis 11. The components may be directly rotatably coupled with one another or intermediate components may interconnect the components for rotation with one another. The mechanical connection between components may include tabs, slots, grooves, splines, ribs, pins, fasteners, a bond layer, integrally formed components, or any other suitable alternative connection.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A gas turbine engine comprising an engine core that includes a compressor stage adapted to rotate about an axis, a turbine stage adapted to rotate about the axis, and a shaft that rotatably couples the compressor stage to the turbine stage to transmit torque from the turbine stage through the shaft to the compressor stage to drive the compressor stage during operation of the gas turbine engine, a tie bolt that extends axially along the axis and locates axially the compressor stage relative to the turbine stage, and a fail-safe system configured to provide backup torque-transfer means for transmitting the torque from the turbine stage to the compressor stage through the tie bolt in response to a shaft disconnect event in which the shaft fails to transmit the torque from the turbine stage to the compressor stage during operation of the gas turbine engine so that the turbine stage is blocked from rotating about the axis faster than the compressor stage during the shaft disconnect event, wherein the fail-safe system includes a fore-torque interface configured to transmit the torque from the tie bolt to the compressor stage in response to the shaft disconnect event and an aft-torque interface configured to transmit the torque from the turbine stage to the tie bolt in response to the shaft disconnect event, wherein the fore-torque interface includes a lug slot formed in one of the tie bolt and the compressor stage and a fore-drive lug coupled to the other of the tie bolt and the compressor stage and the fore-drive lug is located in the lug slot to rotatably couple the compressor stage to the tie bolt.

2. The gas turbine engine of claim 1, wherein the aft-torque interface includes an aft-drive lug and a coupler ring, the aft-drive lug is rotatably coupled to the turbine stage, the coupler ring is rotatably coupled to the tie bolt, the coupler ring is formed to include a driven lug, and the aft-drive lug is configured to transmit at least a portion of the torque to the driven lug in response to the shaft disconnect event so that the torque is transmitted from the turbine stage through the coupler ring and to the tie bolt during the shaft disconnect event.

3. The gas turbine engine of claim 2, wherein the aft-drive lug extends axially away from the turbine stage toward the coupler ring, the driven lug extends axially away from the coupler ring toward the aft-drive lug, and the driven lug is circumferentially aligned with the aft-drive lug.

4. The gas turbine engine of claim 1, wherein the compressor stage includes a hub arranged around the axis and a plurality of airfoils that extend radially away from the hub, the lug slot is formed in the hub of the compressor stage, and the fore-drive lug is coupled to the tie bolt and located in the lug slot.

5. The gas turbine engine of claim 1, wherein the fail-safe system includes a pin that extends at least partway into the tie bolt to rotatably couple the turbine stage to the tie bolt.

6. The gas turbine engine of claim 1, wherein the fail-safe system includes an aft-torque interface that includes an aft-drive lug and a coupler ring, the aft-drive lug is rotatably coupled to the turbine stage, the coupler ring is rotatably coupled to the tie bolt, the coupler ring is formed to include a driven lug, and the driven lug is aligned circumferentially with the aft-drive lug.

7. A gas turbine engine comprising an engine core that includes a compressor stage adapted to rotate about an axis, a turbine stage adapted to rotate about the axis, and a shaft that rotatably couples the compressor stage with the turbine stage for rotation with the turbine stage, a tie bolt that locates the compressor stage axially relative to the turbine stage, and a fail-safe system configured to mechanically interlock and rotatably couple each of the compressor stage and the turbine stage to the tie bolt to transmit torque from the turbine stage to the compressor stage and to physically stop each of the compressor stage and the turbine stage from rotating relative to the tie bolt in response to a shaft disconnect event.

8. The gas turbine engine of claim 7, wherein the fail-safe system includes a fore-torque interface that includes a lug slot formed in one of the tie bolt and the compressor stage and a fore-drive lug coupled to the other of the tie bolt and the compressor stage and the fore-drive lug is located in the lug slot to rotatably couple the compressor stage to the tie bolt.

9. The gas turbine engine of claim 8, wherein the compressor stage includes a hub arranged around the axis and a plurality of airfoils that extend radially away from the hub, the lug slot is formed in the hub of the compressor stage, and the fore-drive lug is coupled to the tie bolt and located in the lug slot.

10. The gas turbine engine of claim 8, wherein the fail-safe system includes an aft-torque interface that includes an aft-drive lug and a coupler ring, the aft-drive lug is rotatably coupled to the turbine stage, the coupler ring is rotatably coupled to the tie bolt, the coupler ring is formed to include a driven lug, and the driven lug is aligned circumferentially with the aft-drive lug.

11. The gas turbine engine of claim 10, wherein the aft-drive lug extends axially away from the turbine stage toward the coupler ring, the driven lug extends axially away from the coupler ring toward the aft-drive lug, and the driven lug is circumferentially aligned with the aft-drive lug.

12. The gas turbine engine of claim 7, wherein the fail-safe system includes an aft-torque interface that rotatably couples the turbine stage to the tie bolt in response to the shaft disconnect event.

13. The gas turbine engine of claim 7, wherein the fail-safe system includes a fore-torque interface that includes a pin that extends at least partway into the compressor stage and at least partway into the tie bolt to rotatably couple the compressor stage to the tie bolt.

14. The gas turbine engine of claim 7, wherein the fail-safe system includes an aft-torque interface that includes a coupler ring configured to rotatably couple to the turbine stage and a pin that extends at least partway into the coupler ring and at least partway into the tie bolt to rotatably couple the coupler ring to the tie bolt.

15. A method comprising applying a compressive force to a compressor stage and a turbine stage with a tie bolt, rotating the turbine stage about an axis, transmitting torque from the turbine stage through a shaft to the compressor stage to rotate the compressor stage about the axis, mechanically interlocking the turbine stage to the tie bolt and the compressor stage to the tie bolt so that the turbine stage and the compressor stage are physically stopped from rotationally slipping relative to the tie bolt in response to a shaft disconnect event in which the shaft no longer transmits the torque from the turbine stage to the compressor stage while the turbine stage is rotating, and transmitting the entire torque from the turbine stage through the tie bolt to the compressor stage to rotate the compressor stage about the axis in response to the shaft disconnect event in which the shaft no longer transmits the torque from the turbine stage to the compressor stage while the turbine stage is rotating.

16. The method of claim 15, wherein transmitting the torque from the turbine stage through the shaft to the compressor stage to rotate the compressor stage about the axis is performed without transmitting the torque from the turbine stage through the tie bolt to the compressor stage.

17. The method of claim 16, further comprising rotating the turbine stage relative to the tie bolt until the turbine stage is rotatably coupled to the tie bolt in response to the shaft disconnect event.

18. The method of claim 15, further comprising rotating the turbine stage at the same speed as the compressor stage during the shaft disconnect event.

19. The gas turbine engine of claim 7, wherein the fail-safe system includes a fore-torque interface and an aft-torque interface spaced apart axially from the fore-torque interface and each of the fore-torque interface and the aft-torque interface includes at least one of a tab, slot, groove, spline, rib, pin, fastener, bond layer, and integrally formed components to mechanically interlock and rotatably couple the compressor stage and the turbine stage to the tie bolt.

20. The gas turbine engine of claim 7, wherein the fail-safe system includes circumferentially abutting features to mechanically interlock and rotatably couple each of the compressor stage and the turbine stage to the tie bolt.

* * * * *